US011251557B2

(12) United States Patent
Dai

(10) Patent No.: US 11,251,557 B2
(45) Date of Patent: Feb. 15, 2022

(54) ELECTRICAL CONNECTOR

(71) Applicant: LOTES CO., LTD, Keelung (TW)

(72) Inventor: Yong Jun Dai, Keelung (TW)

(73) Assignee: LOTES CO., LTD, Keelung (TW)

( * ) Notice: Subject to any disclaimer, the term of this patent is extended or adjusted under 35 U.S.C. 154(b) by 45 days.

(21) Appl. No.: 17/001,877

(22) Filed: Aug. 25, 2020

(65) Prior Publication Data

US 2021/0210885 A1 Jul. 8, 2021

(30) Foreign Application Priority Data

Jan. 7, 2020 (CN) ..... 202020032808.9

(51) Int. Cl.

| | |
|---|---|
| ***H01R 13/24*** | (2006.01) |
| ***H01R 12/55*** | (2011.01) |
| ***H01R 13/6471*** | (2011.01) |
| ***H01R 43/16*** | (2006.01) |

(52) U.S. Cl.

CPC ..... *H01R 13/2407* (2013.01); *H01R 12/55* (2013.01); *H01R 13/2492* (2013.01); *H01R 13/6471* (2013.01); *H01R 43/16* (2013.01)

(58) Field of Classification Search

CPC .. H01R 12/55; H01R 12/714; H01R 13/2407; H01R 13/2435; H01R 13/2492; H01R 13/6471; H01R 43/16

USPC ..... 439/66, 74, 65, 591, 884, 862

See application file for complete search history.

(56) References Cited

U.S. PATENT DOCUMENTS 4,998,886 A * 3/1991 Werner ..... H01R 13/2428 439/631
5,498,166 A * 3/1996 Rothenberger .... H01R 13/5202 439/66
5,951,303 A * 9/1999 Wilmsmann nee Sudmoller ..... H01R 12/52 439/66
5,980,268 A * 11/1999 Mischenko ..... H05K 9/0039 439/66

(Continued)

FOREIGN PATENT DOCUMENTS

| | | |
|---|---|---|
| CN | 101087047 B | 6/2010 |
| CN | 204156149 U | 2/2015 |
| CN | 107994368 A | 5/2018 |

*Primary Examiner* — Marcus E Harcum

(74) *Attorney, Agent, or Firm* — Locke Lord LLP; Tim Tingkang Xia, Esq.

(57) ABSTRACT

An electrical connector includes: an insulating body provided with multiple accommodating holes running vertically therethrough, and multiple terminals correspondingly accommodated in the accommodating holes. Each accommodating hole has two protruding portions. Each terminal includes a main body portion. Two upper elastic arms are formed by bending upward and extending from left and right sides of the main body portion. Each upper elastic arm extends backward to form an upper abutting portion. A strip connecting portion extends upward from the main body portion to be connected to a strip. The strip connecting portion is located between the two upper elastic arms. Each of the left and right sides of the main body portion is provided with a position limiting portion protruding outward. The position limiting portion is located below the protruding portion. The position limiting portion and a corresponding upper elastic arm overlap along a vertical direction.

15 Claims, 7 Drawing Sheets

(56) References Cited

U.S. PATENT DOCUMENTS 6,062,871 A * 5/2000 Arai ..... H01R 12/714 439/66
6,227,869 B1 * 5/2001 Lin ..... H05K 7/1069 439/515
6,241,531 B1 * 6/2001 Roath ..... H01R 12/52 439/591
6,290,507 B1 * 9/2001 Neidich ..... H01R 13/2435 439/66
6,916,186 B2 * 7/2005 Szu ..... H01R 13/2435 439/86
7,128,580 B2 * 10/2006 Liao ..... H01R 13/2435 439/71
7,150,632 B2 * 12/2006 Lee ..... H01R 13/2435 439/66
7,517,224 B2 * 4/2009 Fan ..... H01R 13/2435 439/66
7,988,501 B2 * 8/2011 Chang ..... H05K 7/1069 439/751
8,282,431 B1 * 10/2012 Zhang ..... H01R 13/2435 439/862
8,366,453 B2 * 2/2013 Chang ..... H01R 12/58 439/70
8,641,428 B2 * 2/2014 Light ..... H01R 13/5219 439/66
2004/0102062 A1 * 5/2004 Liao ..... H01R 13/2435 439/66
2005/0037635 A1 * 2/2005 Hsu ..... H01R 13/2435 439/66
2005/0118842 A1 * 6/2005 Perugini ..... H01R 13/2435 439/66
2005/0124183 A1 * 6/2005 Hou ..... H01R 13/2435 439/66
2005/0174746 A1 * 8/2005 Hsiao ..... H01R 12/714 361/769
2006/0040518 A1 * 2/2006 Ma ..... H05K 7/1061 439/66
2006/0040519 A1 * 2/2006 Arai ..... H01R 12/714 439/66
2007/0066091 A1 * 3/2007 Mendenhall ..... H01R 13/2435 439/66
2008/0020638 A1 * 1/2008 Polnyi ..... H01R 13/2435 439/591
2008/0050939 A1 * 2/2008 Polnyi ..... H01R 12/714 439/66
2008/0050940 A1 * 2/2008 Lin ..... H01R 13/2435 439/66
2008/0293264 A1 * 11/2008 Trout ..... H01R 13/633 439/74
2009/0156021 A1 * 6/2009 Polnyi ..... H01R 12/7076 439/66
2009/0253287 A1 * 10/2009 Polnyi ..... H01R 13/2457 439/331
2009/0263985 A1 * 10/2009 Liu ..... H01R 13/2492 439/66
2009/0269950 A1 * 10/2009 Liao ..... H01R 13/2492 439/66
2010/0009557 A1 * 1/2010 Hsiao ..... H05K 7/1069 439/66
2010/0029102 A1 * 2/2010 Chen ..... H05K 7/1069 439/66
2010/0093191 A1 * 4/2010 Yuan ..... H01R 12/57 439/66
2010/0173506 A1 * 7/2010 Adachi ..... H01R 12/714 439/66
2010/0184334 A1 * 7/2010 Ma ..... H01R 13/2442 439/626
2010/0291774 A1 * 11/2010 Cheng ..... H01R 13/2435 439/66
2011/0151688 A1 * 6/2011 Beaman ..... H01R 12/585 439/66
2011/0256771 A1 * 10/2011 Jin ..... H01R 13/41 439/626
2020/0144747 A1 * 5/2020 Cheng ..... H01R 13/41
2020/0303856 A1 * 9/2020 Liao ..... H01R 13/41
2021/0021067 A1 * 1/2021 Hsu ..... H01R 12/714
2021/0119360 A1 * 4/2021 Ou ..... H01R 12/7082
2021/0210886 A1 * 7/2021 Hwang ..... H01R 13/2407

* cited by examiner

100

A-A

100

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN202020032808.9 filed in China on Jan. 7, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector having terminals capable of being compressed in both directions.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent Publication No. CN200610085932.6 teaches an electrical connector, including an insulating body and terminals accommodated therein. The terminals are used to electrically connect a chip module and a circuit board. Each terminal mainly includes a main body portion, and two first arm portions and two second arm portions respectively extending from the main body portion toward two opposite sides obliquely upward and obliquely downward. That is, each of the two sides of the main body portion are respectively provided with two arm portions. The first arm portion and the second arm portion corresponding to each other are connected by a connecting portion. A tail end of each of the arm portions is provided with a first contact portion and a second contact portion being arc-shaped and respectively conductively connected to the chip module and the circuit board. The other two sides of the main body portion are respectively provided with clamping portions being plate shaped, and the same side of two ends of each clamping portion are symmetrically provided with small protruding blocks protruding outward.

However, the two clamping portions and the two first arm portions of each terminal are provided side-by-side along a width direction of the terminal, and the two first arm portions are located between the two clamping portions, such that a distance between the outermost sides of the two first arm portions being less than a distance between the outermost sides of the two clamping portions of a same terminal, the distance between the outermost sides of the two first arm portions is smaller, and the terminal impedance is smaller. In addition, the two clamping portions are provided at the outermost sides of the two first arm portions, and in the signal transmission process, the signal may be transmitted to adjacent channels through the two clamping portions, causing crosstalk and interferences between the terminals. Further, the two clamping portions are provided at the outermost sides of the two first arm portions, and a distance between the two adjacent first arm portions of two adjacent terminals is larger. The shielding effect will be affected if the two adjacent terminals along the width direction are respectively a ground terminal and a signal terminal. Moreover, the two clamping portions are provided at the outermost sides of the two first arm portions, such that the space occupied by the terminal in the width direction is larger, which is unfavorable to the developing trend of the dense arrangement of the terminals. Further, the spaces of the two clamping portions elastically deforming along the width of the terminal and the gap between the two first arm portions are provided at intervals along the width direction of the terminal, such that the space occupied by the terminal in the width direction is larger, which is unfavorable to the developing trend of the dense arrangement of the terminals.

Therefore, a heretofore unaddressed need to design an improved electrical connector exists in the art to address the aforementioned deficiencies and inadequacies.

SUMMARY

The present invention is directed to an electrical connector which may increase the arrangement density of the terminals and improve the crosstalk and interferences between the terminals.

To achieve the foregoing objective, the present invention adopts the following technical solutions.

An electrical connector is configured to electrically connect a mating component to a circuit board. The electrical connector includes: an insulating body, provided with a plurality of accommodating holes running through the insulating body vertically, wherein each of the accommodating holes is provided with two protruding portions; and a plurality of terminals, correspondingly accommodated in the accommodating holes, wherein each of the terminals comprises: a main body portion, having a through slot running through the main body portion along a front-rear direction; two upper elastic arms formed by bending upward and extending from a left side and a right side of the main body portion; two upper abutting portions, wherein each of the upper abutting portions is formed by extending backward from one of the upper elastic arms to upward abut the mating component; a strip connecting portion formed by extending upward from the main body portion to be connected to a strip, wherein the strip connecting portion is located between the two upper elastic arms; two lower elastic arms formed by bending downward and extending from the left side and the right side of the main body portion; two lower abutting portions, wherein each of the lower abutting portions is formed by extending backward from one of the lower elastic arms to downward abut the circuit board; a connecting portion connecting the two lower elastic arms and having two ends corresponding to the two lower elastic arms and the two lower abutting portions, wherein each of the two ends of the connecting portion is located between a bending location of a corresponding one of the two lower elastic arms connected to the main body portion and a corresponding one of the two lower abutting portions, and the through slot extends to the connecting portion; and two position limiting portions provided by protruding outward from the left side and the right side of the main body portion, wherein the position limiting portions are located below the protruding portions to limit each of the terminals from moving upward, a height of each of the position limiting portions is between an upper end and a lower end of the through slot, and each of the position limiting portions and a corresponding one of the upper elastic arms overlap along a vertical direction.

In certain embodiments, two stopping blocks protrude toward each other from a left side and a right side of each of the accommodating holes, the two stopping block are located behind the main body portion to limit the main body portion from moving backward, and the two stopping block are located at a left side and a right side of the through slot and right below the upper elastic arms.

In certain embodiments, each of the stopping blocks has a guide surface formed backward and upward obliquely from a front side thereof, a lowest point of the guide surface is lower than a bending location of each of the upper elastic arms connected to the main body portion, and a highest point of the guide surface is higher than the bending location of each of the upper elastic arms connected to the main body portion.

In certain embodiments, each of the lower elastic arms comprises a first section bending backward from the main body portion and extending downward, and a second section extending backward and downward from the first section, a distance between the two second sections of the two lower elastic arms is greater than a distance between the two first sections of the two lower elastic arms of each of the terminals, the connecting portion connects the two first sections of the two lower elastic arms, and in a projection along the vertical direction, the two first sections of the two lower elastic arms of each of the terminals are located between the two stopping blocks of a corresponding one of the accommodating holes.

In certain embodiments, each of the lower abutting portions is formed by extending backward and downward from the second section of the one of the lower elastic arms, and the distance between the two second sections of the two lower elastic arms is greater than a distance between the two lower abutting portions of each of the terminals.

In certain embodiments, gaps exist between the position limiting portions and the protruding portions, such that each of the terminals is vertically movably positioned in a corresponding one of the accommodating holes, and the upper elastic arms, the upper abutting portions, the lower elastic arms and the lower abutting portions are all located at a rear side of the main body portion.

In certain embodiments, the terminals comprise a signal terminal and a ground terminal provided side-by-side symmetrically adjacent to each other in a left-right direction, and a distance between two adjacent upper elastic arms of the signal terminal and the ground terminal is less than a width of the strip connecting portion of the signal terminal or the ground terminal.

In certain embodiments, the terminals comprise a signal terminal and a ground terminal provided side-by-side adjacent to each other in a left-right direction, and two outer sides of the two upper elastic arms pass outward beyond two outer sides of the two position limiting portions of each of the terminals.

In certain embodiments, each of a left side and a right side of the strip connecting section has a tearing edge formed by tearing from a corresponding one of the upper elastic arms, the tearing edge at the left side of the strip connecting section passes leftward beyond a left side of the through slot, and the tearing edge at the right side of the strip connecting section passes rightward beyond a right side of the through slot.

To achieve the foregoing objective, the present invention further adopts the following technical solutions.

An electrical connector is configured to be electrically connected to a mating component. The electrical connector includes: an insulating body, provided with a plurality of accommodating holes running through the insulating body vertically, wherein each of the accommodating holes is provided with two protruding portions; and a signal terminal and a ground terminal provided side-by-side adjacent to each other in a left-right direction, correspondingly accommodated in the accommodating holes, wherein the ground terminal is provided with: a main body portion, having a through slot running through the main body portion along a front-rear direction; two upper elastic arms formed by bending upward and extending from a left side and a right side of the main body portion; at least one upper abutting portion located behind the main body portion, configured to upward abut the mating component; two lower elastic arms formed by bending downward and extending from the left side and the right side of the main body portion; a connecting portion connecting the two lower elastic arms and having two ends corresponding to the two lower elastic arms, wherein each of the two ends of the connecting portion is located below a bending location of a corresponding one of the two lower elastic arms connected to the main body portion, and the through slot extends to the connecting portion; and two position limiting portions provided by protruding from the left side and the right side of the main body portion, wherein the position limiting portions are located below the protruding portions to limit the ground terminal from moving upward, a height of each of the position limiting portions is between an upper end and a lower end of the through slot, and along a vertical direction, each of the position limiting portions and a corresponding one of the upper elastic arms overlap, and the through slot and a gap between the two upper elastic arms overlap.

In certain embodiments, a strip connecting portion is formed by extending upward from the main body portion to be connected to a strip, the strip connecting portion is located between the two upper elastic arms, two upper abutting portions and two lower abutting portions are provided, each of the upper abutting portions is formed by extending backward from one of the upper elastic arms, each of the lower abutting portions is formed by extending backward from one of the lower elastic arms to downward abut a circuit board, two stopping blocks protrude toward each other from a left side and a right side of each of the accommodating holes, the two stopping block are located behind the main body portion to limit the main body portion from moving backward, and the two stopping block are located at a left side and a right side of the through slot and right below the upper elastic arms.

In certain embodiments, each of the lower elastic arms comprises a first section bending backward and downward from the main body portion and extending downward, and a second section extending backward and downward from the first section, a distance between the two second sections of the two lower elastic arms is greater than a distance between the two first sections of the two lower elastic arms, the connecting portion connects the two first sections of the two lower elastic arms, and in a projection along the vertical direction, the two first sections of the two lower elastic arms are located between the two stopping blocks of a corresponding one of the accommodating holes.

In certain embodiments, a distance between two adjacent upper elastic arms of the signal terminal and the ground terminal provided side-by-side symmetrically adjacent to each other in the left-right direction is less than a width of the strip connecting portion of the signal terminal or the ground terminal.

In certain embodiments, each of a left side and a right side of the strip connecting section has a tearing edge formed by tearing from a corresponding one of the upper elastic arms, the tearing edge at the left side of the strip connecting section passes leftward beyond a left side of the through slot, and the tearing edge at the right side of the strip connecting section passes rightward beyond a right side of the through slot.

In certain embodiments, each of the left side and the right side of the main body portion is provided with one of the position limiting portions, and two outer sides of the two upper elastic arms pass outward beyond two outer sides of the two position limiting portions of each of the terminals.

Compared with the related art, certain embodiments of the present invention have the following beneficial effects. The two upper elastic arms are formed by extending from the left side and the right side of the main body portion, such that each of the position limiting portions and a corresponding upper elastic arm overlap along the vertical direction. In other words, the position limiting portions are provided using the space below the upper elastic arms, thereby reducing the width of each terminal along the left-right direction, and allowing the insulating body to accommodate more terminals. In addition, comparing with the related art where the position limiting portions are arranged at the outer sides of the upper elastic arms in the left-right direction, the upper elastic arms of each terminal may be provided wider, thereby increasing the impedance thereof, improving the high frequency of the electrical connector, preventing from the crosstalk and interferences between the terminals in the related art, and enhancing the characteristics of the electrical connector. Further, comparing with the case where the position limiting portions are arranged at the outer sides of the upper elastic arms in the left-right direction, the distance between the two adjacent upper elastic arms of two adjacent terminals in the left-right direction is smaller, and the shielding effect will be enhanced if the two adjacent terminals along the width direction are respectively a ground terminal and a signal terminal. Further, by providing the through slot to run through the main body portion along the front-rear direction and to extend to the connecting portion, each of the two ends of the connecting portion is located between the bending location of a corresponding one of the two lower elastic arms connected to the main body portion and a corresponding one of the two lower abutting portions, such that the lower portions of the main body portion located at the two sides of the through slot are not connected together. In the process of assembling each of the terminals to the insulating body, when the position limiting portions pass the protruding portions, the protruding portions squeeze the position limiting portions. Comparing to the case where the connecting portion is provided at the lower portions of the main body portion (in other words, the lower portions of the main body portion located at the two sides of the through slot are connected together; when the protruding portions squeeze the position limiting portions, the lower portions of the main body portion located at the two sides of the through slot are connected together, and the main body portion and the two position limiting portions do not easily move close to the middle, resulting in difficulties for the position limiting portions to pass the protruding portions, and the position limiting portions may even damage the insulating body), the lower portions of the main body portion located at the two sides of the through slot are not restricted, and may easily move close to the through slot, such that the position limiting portions may pass the protruding portions and move to be below the protruding portions to limit the corresponding terminal from moving upward. In addition, the two upper elastic arms are formed by bending and extending backward and upward from the left side and the right side of the main body portion, and the through slot runs through the main body portion along the front-rear direction, such that the through slot and the upper elastic arms are arranged vertically. Further, the space below the gap between the two upper elastic arms is used to form the through slot to provide the space for elastic deformation of the position limiting portions, reducing the width of the corresponding terminal in the left-right direction, allowing the insulating body to accommodate more terminals, and enhancing the arrangement density of the terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
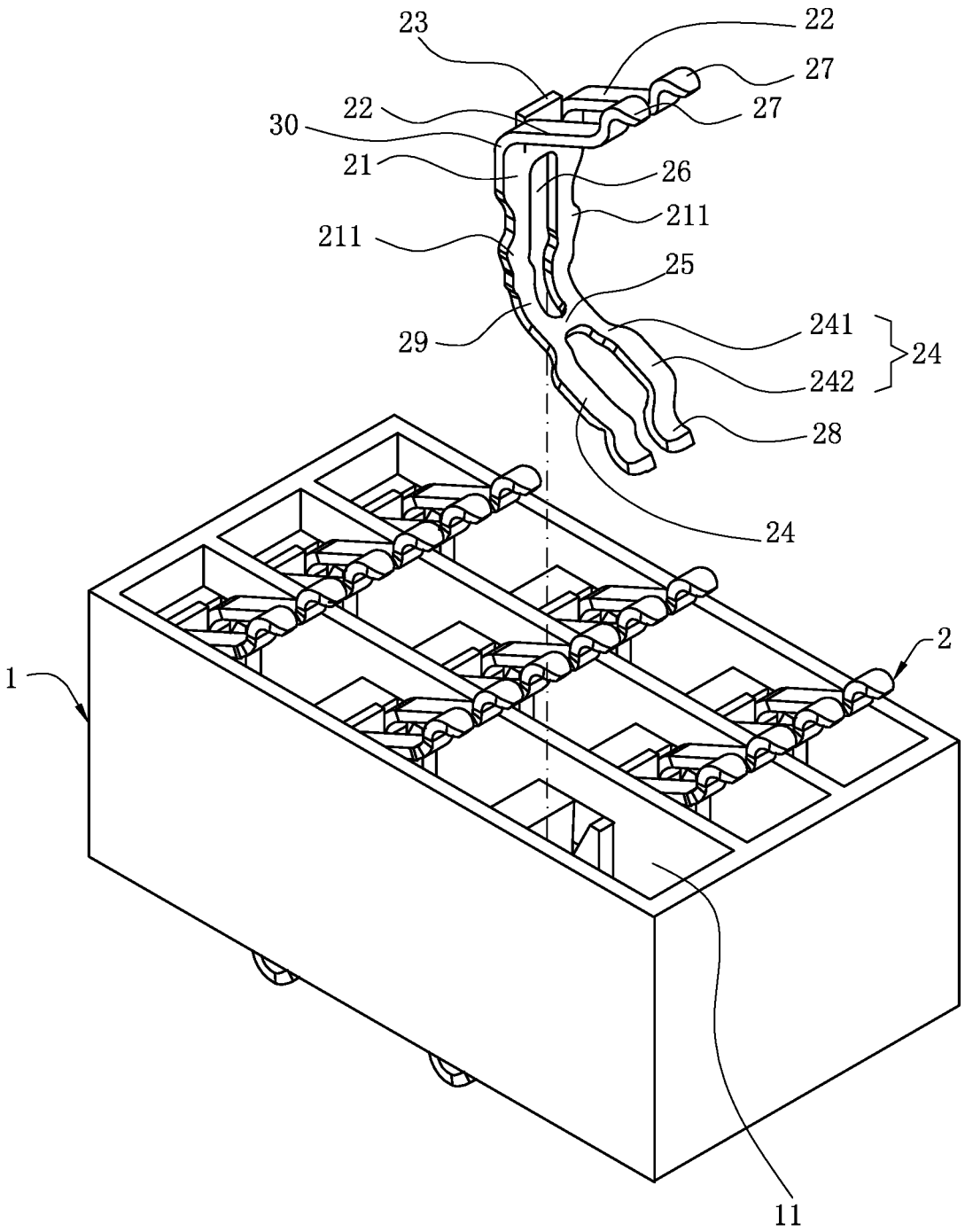
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

FIGS. 1-7 shows an electrical connector 100 according to one embodiment of the present invention, which is used to electrically connect a mating component 200 (in this embodiment, the mating component 200 is a chip module) to a circuit board 300. The electrical connector 100 includes a plurality of terminals 2 and an insulating body 1 accommodating the terminals 2. In this embodiment, only some of the terminals 2 of the electrical connector 100 are shown, and these terminals 2 have identical structures. In other embodiments, the terminals of the electrical connector 100 do not all have identical structures. In other words, the electrical connector 100 may include two types of terminals having different structures.

Figure 4:
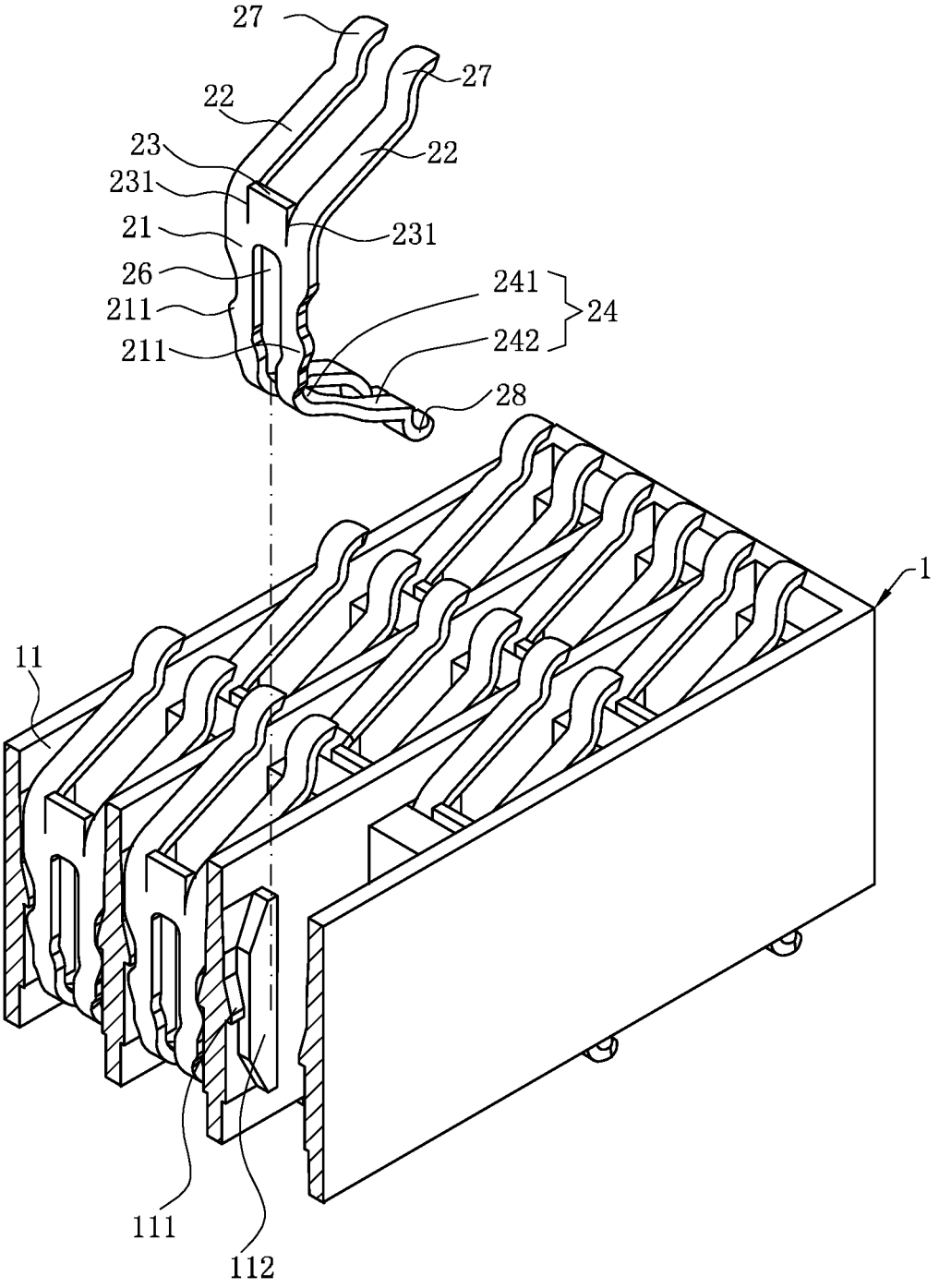
FIG. 4 is a perspective sectional view of the electrical connector of FIG. 2 in a different angle along the line A-A.
Figure 6:
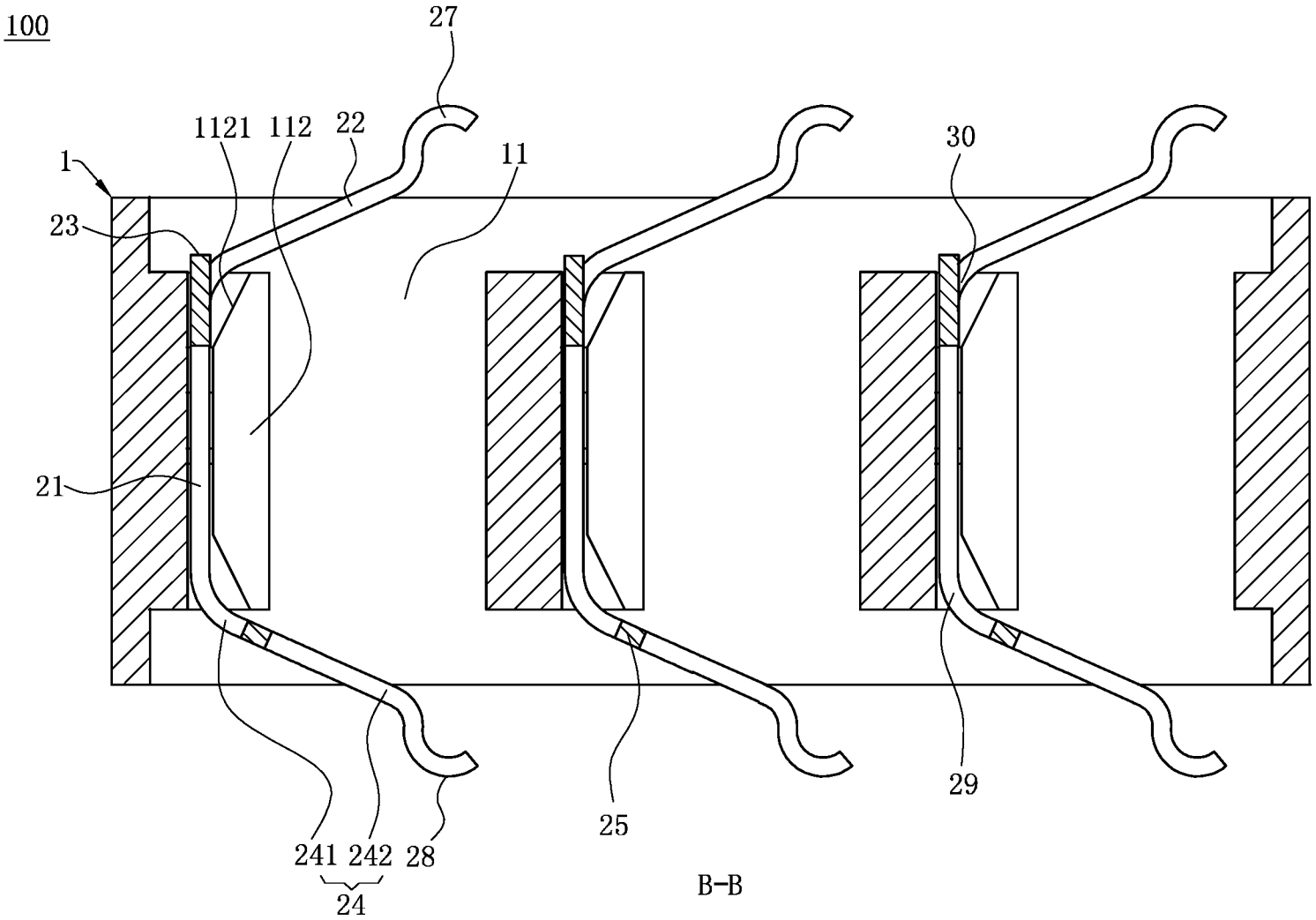
FIG. 6 is a perspective sectional view of the electrical connector of FIG. 2 along the line B-B.

As shown in FIG. 1, FIG. 4 and FIG. 6, the insulating body 1 is provided with a plurality of accommodating holes 11 running through the insulating body 1 vertically to correspondingly accommodate the terminals 2. Each of a left side and a right side of each of the accommodating holes 11 is provided with a protruding portion 111. Two stopping blocks 112 protrude toward each other from the left side and the right side of each of the accommodating holes 11. The protruding portions 111 are located in front of the stopping blocks 112. Each of the stopping blocks 112 has a guide surface 1121 formed backward and upward obliquely from a front side of the corresponding stopping block 112.

Figure 2:
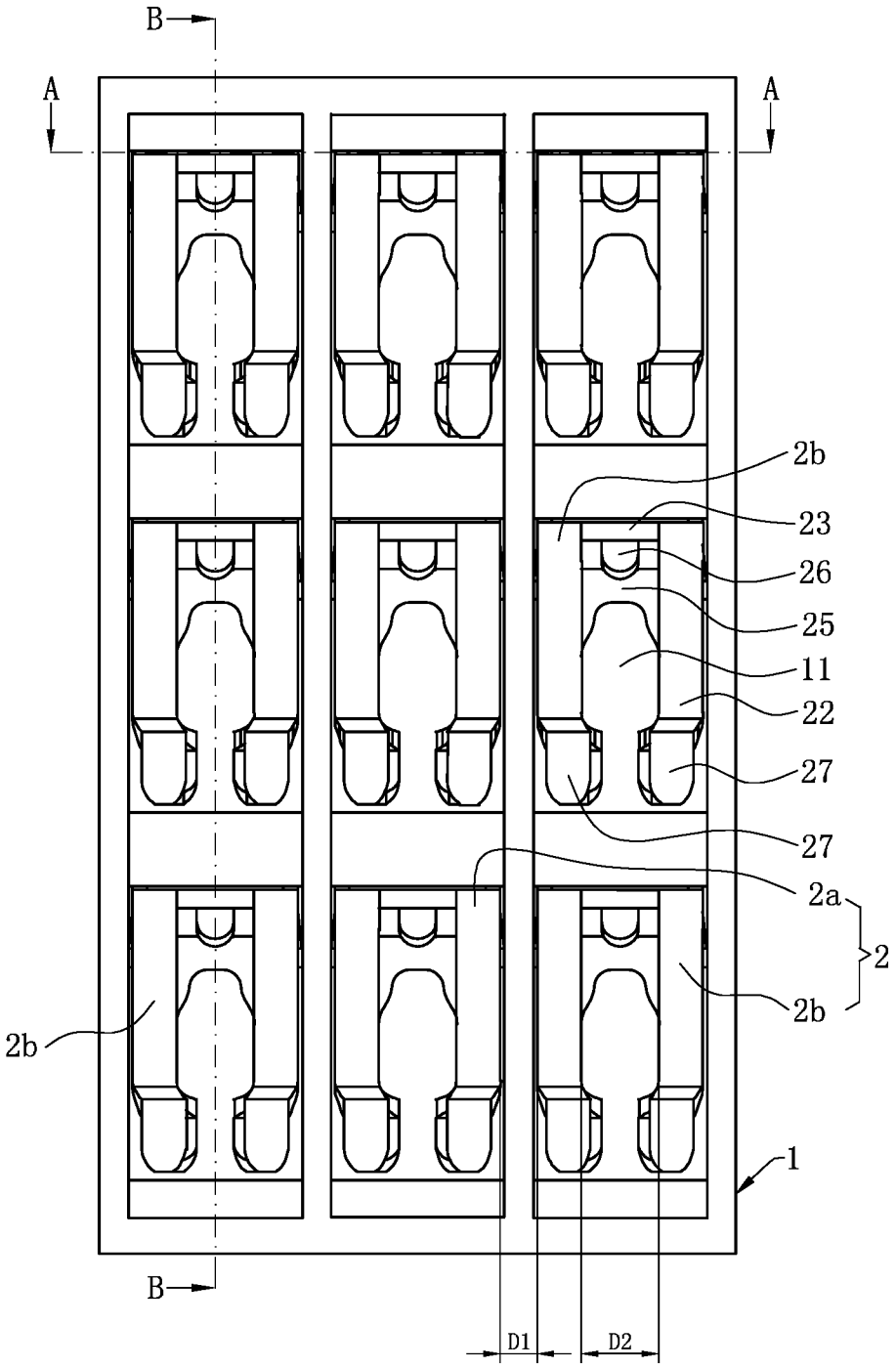
FIG. 2 is a top view of an electrical connector according to certain embodiments of the present invention.
Figure 3:
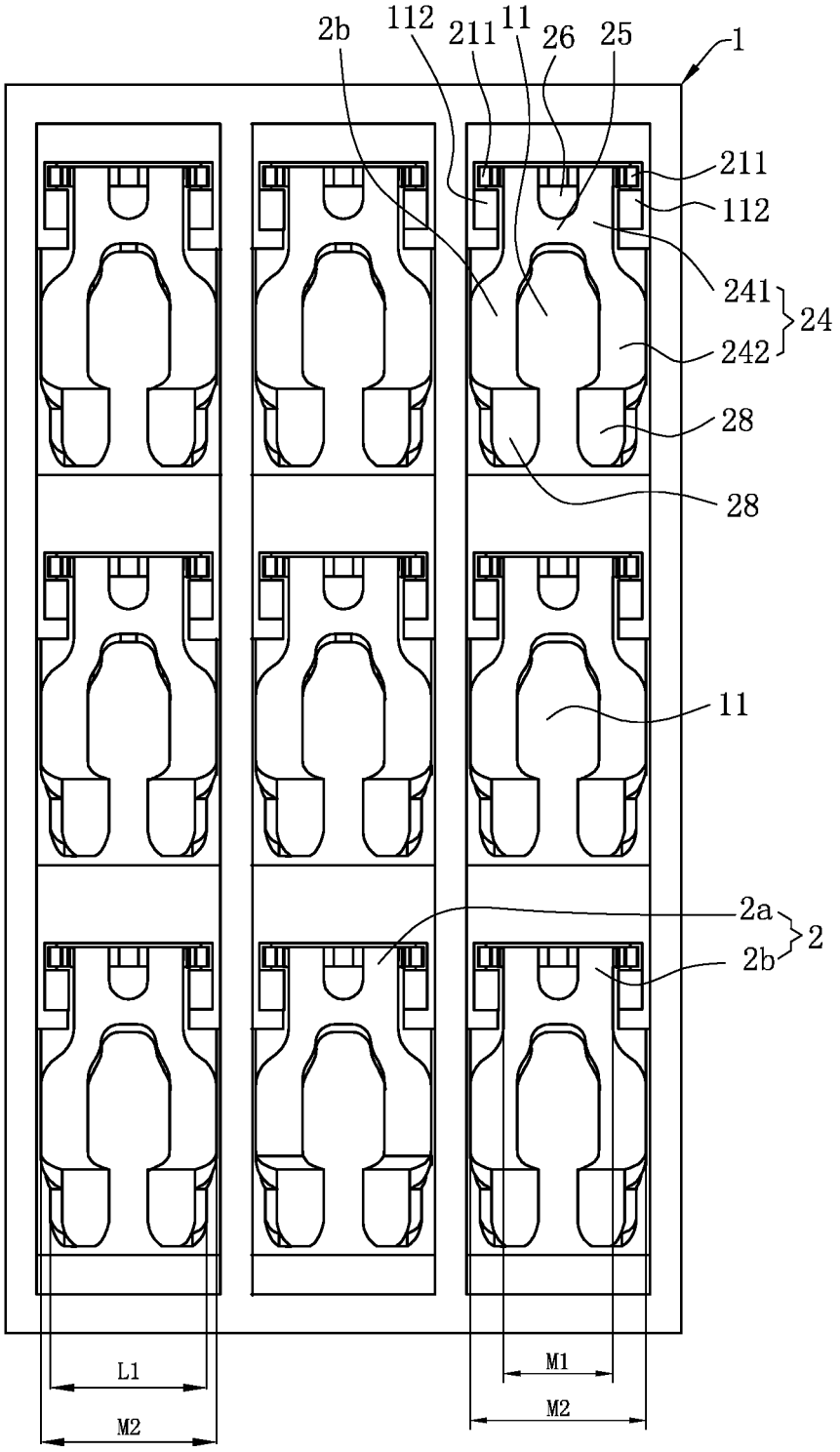
FIG. 3 is a bottom view of FIG. 2.
Figure 5:
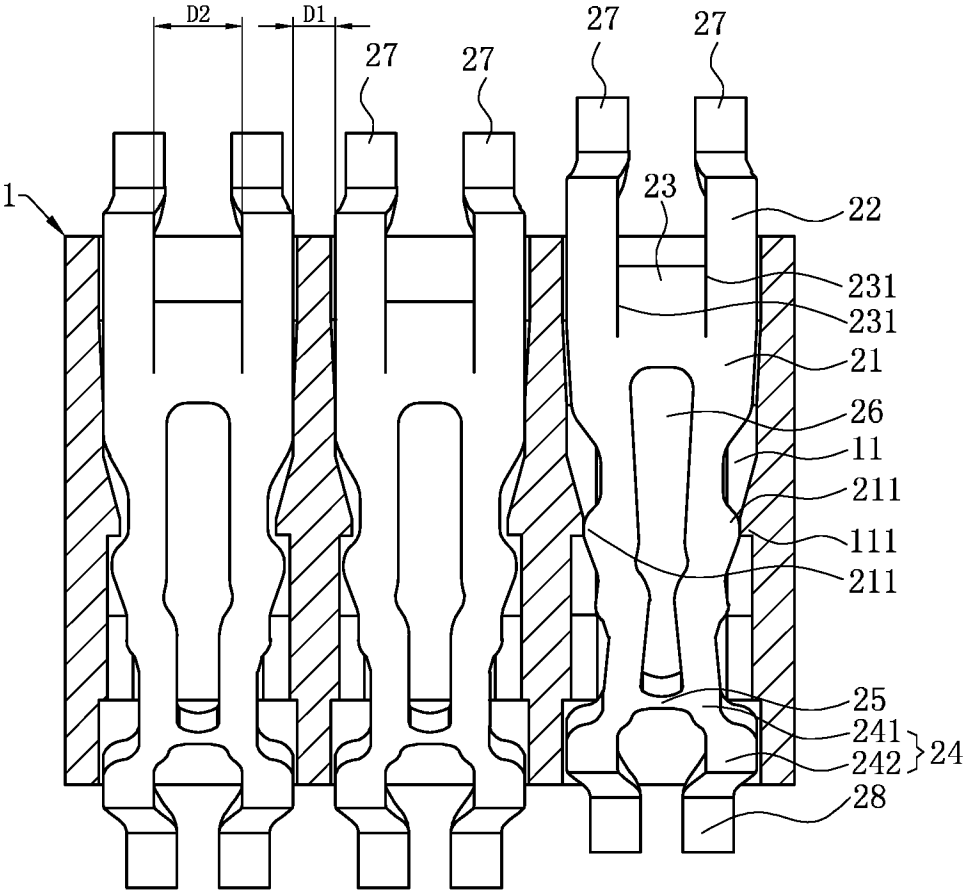
FIG. 5 is a plain sectional view of the terminal of FIG. 4 in a process of being assembled to the insulating body when the position limiting portion passes the protruding portion.
Figure 7:
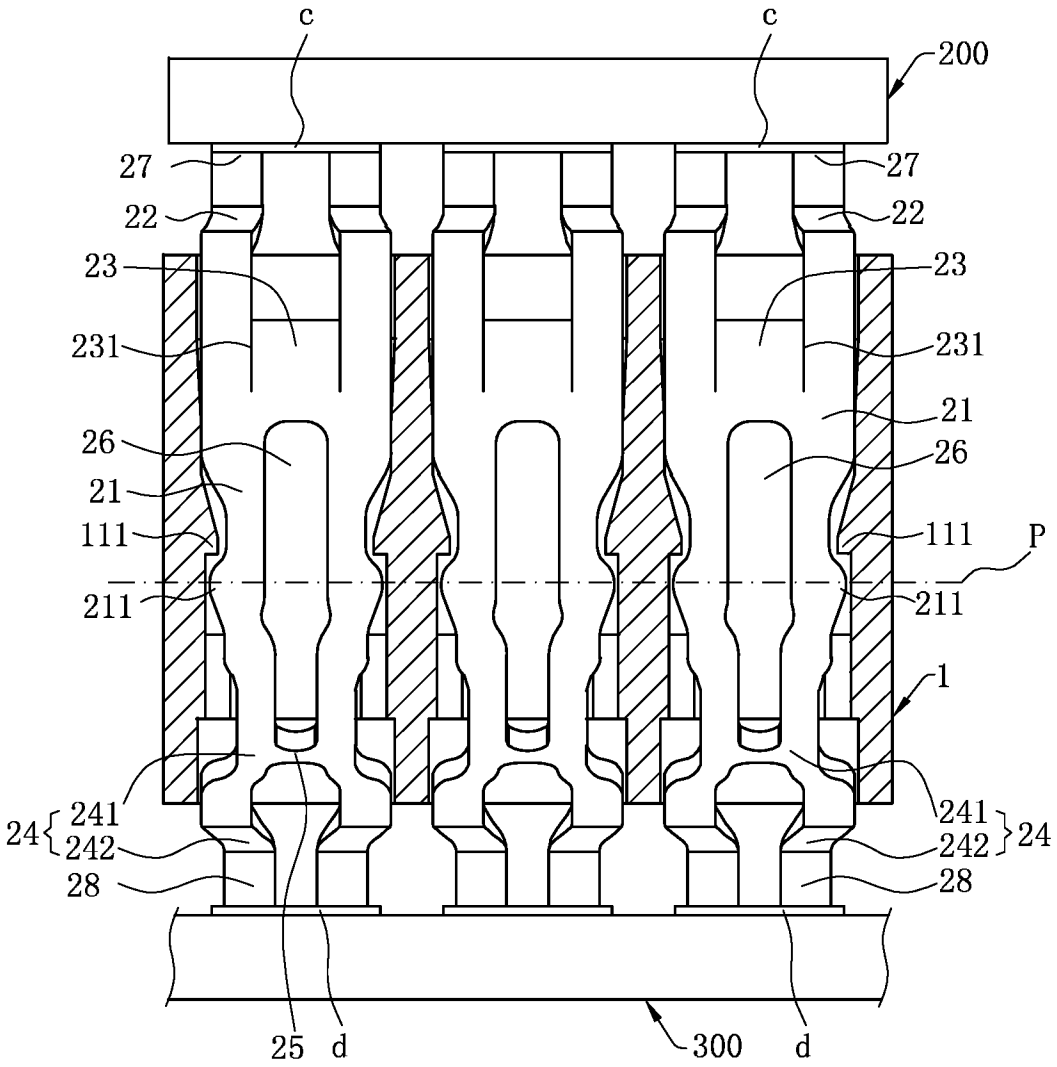
FIG. 7 is a plain sectional view of the electrical connector of FIG. 5 electrically connecting a mating component and a circuit board.

As shown in FIG. 1, FIG. 2 and FIG. 7, the terminals 2 include a signal terminal 2*a* and a ground terminal 2*b* provided side-by-side and symmetrically adjacent to each other in a left-right direction. In this embodiment, the signal terminal 2*a* and the ground terminal 2*b* have identical structures. In other embodiments, the signal terminal 2*a* and the ground terminal 2*b* may have different structures. Each of the terminals 2 includes a main body portion 21, which is flat plate shaped, having a through slot 26 runs through the main body portion 21 along the front-rear direction. The two stopping blocks 112 are located behind the main body portion 21 to limit the main body portion 21 from moving backward. Two upper elastic arms 22 are formed by bending and extending backward and upward from a left side and a right side of the main body portion 21. In other embodiments, the upper elastic arms 22 may be formed by bending forward from the main body portion 21 and then bending backward. A lowest point of the guide surface 1121 is lower than a bending location 30 of each of the upper elastic arms 22 connected to the main body portion 21, and a highest point of the guide surface 1121 is higher than the bending location 30 of each of the upper elastic arms 22 connected to the main body portion 21. Each of the upper elastic arms 22 extends backward to form an upper abutting portion 27 (and in other embodiments, the two upper elastic arms 22 may be connected together, and thus only one upper abutting portion 27 is provided) to upward abut the mating component 200. The two upper abutting portions 27 abut a same contact sheet c of the mating component 200 (as shown in FIG. 7). A strip connecting portion 23 is formed by extending upward from the main body portion 21 to be connected to a strip (not shown). The strip connecting portion 23 is located between the two upper elastic arms 22. A spacing D1 between two adjacent upper elastic arms 22 of the signal terminal 2*a* and the ground terminal 2*b* provided side-by-side adjacent to each other in the left-right direction is less than a width D2 of the strip connecting portion 23 (as shown in FIG. 2 and FIG. 5). Each of a left side and a right side of the strip connecting section 23 has a tearing edge 231 formed by tearing from a corresponding upper elastic arm 22 (as shown in FIG. 4), such that the two upper elastic arms 22 of the signal terminal 2*a* may be provided wider, and the two upper elastic arms 22 of the ground terminal 2*b* may be provided wider. Two lower elastic arms 24 are formed by bending and extending backward and downward from the left side and the right side of the main body portion 21. In other embodiments, the lower elastic arms 24 may be formed by bending forward from the main body portion 21 and then bending backward. Each of the lower elastic arms 24 includes a first section 241 bending backward from the main body portion 21 and extending downward, and a second section 242 extending backward and downward from the first section 241. In each of the terminals 2, a distance M2 between the two second sections 242 of the two lower elastic arms 24 is greater than a distance M1 between the two first sections 241 of the two lower elastic arms 24 (as shown in FIG. 3). In a projection along the vertical direction, the two first sections 241 of the two lower elastic arms 24 of each of the terminals 2 are located between the two stopping blocks 112 of a corresponding accommodating hole 11. In each of the terminals 2, a left side edge of the second section 242 located at the left side and a left side edge of the upper elastic arm 22 located at the left side are aligned vertically, and a right side edge of the second section 242 located at the right side and a right side edge of the upper elastic arm 22 located at the right side are aligned vertically. Two lower abutting portions 28 are used to downward abut a same conductive sheet d of the circuit board 300 (as shown in FIG. 7). The lower abutting portions 28 are formed by extending backward and downward from the second sections 242 of the lower elastic arms 24. In each of the terminals 2, the distance M2 between the two second sections 242 of the two lower elastic arms 24 is greater than a distance L1 between the two lower abutting portions 28 (as shown in FIG. 3). A connecting portion 25 connects the two lower elastic arms 24, and has two ends corresponding to the two lower elastic arms 24 and the two lower abutting portions 28. Each of the two ends of the connecting portion 25 is located between a bending location 29 of a corresponding one of the two lower elastic arms 24 connected to the main body portion 21 and a corresponding one of the two lower abutting portions 28. In this embodiment, the connecting portion 25 connects the two first sections 241 of the lower elastic arms 24. The through slot 26 extends to the connecting portion 25. The tearing edge 231 at the left side of the strip connecting section 23 passes leftward beyond a left side of the through slot 26, and the tearing edge 231 at the right side of the strip connecting section 23 passes rightward beyond a right side of the through slot 26. The two stopping blocks 112 are located at the left and right sides of the through slot 26. Along the vertical direction, the through slot 26 and a gap between the two upper elastic arms 22 overlap. As shown in FIG. 4 and FIG. 6, each of the left side and the right side of the main body portion 21 is provided with a position limiting portion 211. The position limiting portions 211 are located below the protruding portions 111 to limit the corresponding terminal 2 from moving upward. Gaps exist between the position limiting portions 211 and the protruding portions 111, such that the corresponding terminal 2 may be vertically movably positioned in the corresponding accommodating hole 11. In each of the terminals 2, two outer sides of the two upper elastic arms 22 pass outward beyond two outer sides of the two position limiting portions 211. Along the vertical direction, each of the position limiting portions 211 and a corresponding upper elastic arm 22 overlap. A height of each of the position limiting portions 211 is between an upper end and a lower end of the through slot 26. A horizontal plane P passes a middle location between the upper end and the lower end of the through slot 26. A distance between each of the position limiting portions 211 and the horizontal plane P is less than a distance between each of the position limiting portions 211 and the upper end of the through slot 26, and the distance between each of the position limiting portions 211 and the horizontal plane P is less than a distance between each of the position limiting portions 211 and the lower end of the through slot 26. The upper elastic arms 22, the upper abutting portions 27, the lower elastic arms 24 and the lower abutting portions 28 are all located at a rear side of the main body portion 21.

To sum up, the electrical connector 100 according to certain embodiments of the present invention has the following beneficial effects.

1. The two upper elastic arms 22 are formed by extending from the left side and the right side of the main body portion 21, such that each of the position limiting portions 211 and a corresponding upper elastic arm 22 overlap along the vertical direction. In other words, the position limiting portions 211 are provided using the space below the upper elastic arms 22, thereby reducing the width of each terminal 2 along the left-right direction, and allowing the insulating body 1 to accommodate more terminals 2. In addition, comparing with the case where the position limiting portions 211 are arranged at the outer sides of the upper elastic arms 22 in the left-right direction, the upper elastic arms 22 of each terminal 2 may be provided wider, thereby increasing the impedance thereof, improving the high frequency of the electrical connector 100, preventing from the crosstalk and interferences between the terminals 2 in the related art, and enhancing the characteristics of the electrical connector 100. Further, comparing with the case where the position limiting portions 211 are arranged at the outer sides of the upper elastic arms 22 in the left-right direction, the distance between the two adjacent upper elastic arms 22 of two adjacent terminals 2 in the left-right direction is smaller, and the shielding effect will be enhanced if the two adjacent terminals 2 along the width direction are respectively a ground terminal 2*b* and a signal terminal 2*a*. Further, by providing the through slot 26 running through the main body portion 21 along the front-rear direction and extends to the connecting portion 25, each of the two ends of the connecting portion 25 is located between the bending location 29 of a corresponding one of the two lower elastic arms 24 connected to the main body portion 21 and a corresponding one of the two lower abutting portions 28, such that the lower portions of the main body portion 21 located at the two sides of the through slot 26 are not connected together. In the process of assembling each of the terminals 2 to the insulating body 1, when the position limiting portions 211 pass the protruding portions 111, the protruding portions 111 squeeze the position limiting portions 211. Comparing to the case where the connecting portion 25 is provided at the lower portions of the main body portion 21 (where the lower portions of the main body portion 21 located at the two sides of the through slot 26 are connected together; when the protruding portions 111 squeeze the position limiting portions 211, the lower portions of the main body portion 21 located at the two sides of the through slot 26 are connected together, and the main body portion 21 and the two position limiting portions 211 do not easily move close to the middle, resulting in difficulties for the position limiting portions 211 to pass the protruding portions 111, and the position limiting portions 211 may even damage the insulating body 1), the lower portions of the main body portion 21 located at the two sides of the through slot 26 are not restricted, and may easily move close to the through slot 26, such that the position limiting portions 211 may pass the protruding portions 111 and move to be below the protruding portions 111 to limit the corresponding terminal 2 from moving upward. In addition, the two upper elastic arms 22 are formed by extending from the left side and the right side of the main body portion 21, and the through slot 26 and the gap between the two upper elastic arms 22 overlap along the vertical direction, such that the space below the gap between the two upper elastic arms 22 is used to form the through slot 26 to provide the space for elastic deformation of the position limiting portions 211, reducing the width of the corresponding terminal 2 in the left-right direction, and allowing the insulating body 1 to accommodate more terminals 2.

2. The two stopping blocks 112 are provided to be located behind the main body portion 21 to limit the main body portion 21 from moving backward, and the two stopping blocks 112 are located at the left and right sides of the through slot 26, such that the middle portion of the main body portion 21 have more air flowing therethrough, facilitating heat dissipation of each terminal 2.

3. The stopping blocks 112 are provided to be located right below the upper elastic arms 22, such that the upper elastic arms 22 of each terminal 2 are located closer to the two side walls of the corresponding accommodating hole 11 in the left-right direction, the distance between the two adjacent upper elastic arms 22 of two adjacent terminals 2 in the left-right direction is smaller, and the shielding effect will be enhanced if the two adjacent terminals 2 along the width direction are respectively a ground terminal 2*b* and a signal terminal 2*a*.

4. A lowest point of the guide surface 1121 is lower than a bending location 30 of each of the upper elastic arms 22 connected to the main body portion 21, and a highest point of the guide surface 1121 is higher than the bending location 30 of each of the upper elastic arms 22 connected to the main body portion 21, thus preventing the bending location 30 of each of the upper elastic arms 22 connected to the main body portion 21 from touching the corresponding stopping block 112 and causing deformation of each of the upper elastic arms 22.

5. In the projection along the vertical direction, the two first sections 241 of the two lower elastic arms 24 of each of the terminals 2 are located between the two stopping blocks 112 of the corresponding accommodating hole 11, thus preventing the lower elastic arms 24 from touching the stopping blocks 112 to affect the assembling of the terminals in the process of assembling each of the terminals 2 to the insulating body 1.

6. The two adjacent terminals 2 in the left-right direction are respectively a ground terminal 2*b* and a signal terminal 2*a*. By providing the distance between the two adjacent upper elastic arms 22 of the two adjacent terminals in the left-right direction to be less than the width of the strip connecting portion, the distance between the two upper elastic arms 22 of the same ground terminal 2*b* is larger, the distance between the two upper elastic arms 22 of the same signal terminal 2*a* is larger, and the distance between the two adjacent upper elastic arms 22 of the ground terminal 2*b* and the signal terminal 2*a* adjacent to each other in the left-right direction is smaller, thus enhancing the shielding effect.

7. By providing the two outer sides of the two upper elastic arms 22 to pass outward beyond the two outer sides of the two position limiting portions 211 in a same terminal 2, the distance between the two adjacent upper elastic arms 22 of the ground terminal 2*b* and the signal terminal 2*a* adjacent to each other in the left-right direction is smaller, and the shielding effect will be enhanced if the two adjacent terminals 2 in the left-right direction are respectively a ground terminal 2*b* and a signal terminal 2*a*.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a mating component to a circuit board, the electrical connector comprising:

an insulating body, provided with a plurality of accommodating holes running through the insulating body vertically, wherein each of the accommodating holes is provided with two protruding portions; and a plurality of terminals, correspondingly accommodated in the accommodating holes, wherein each of the terminals comprises:

a main body portion, having a through slot running through the main body portion along a front-rear direction;

two upper elastic arms formed by bending upward and extending from a left side and a right side of the main body portion;

two upper abutting portions, wherein each of the upper abutting portions is formed by extending backward from one of the upper elastic arms to upward abut the mating component;

a strip connecting portion formed by extending upward from the main body portion to be connected to a strip, wherein the strip connecting portion is located between the two upper elastic arms;

two lower elastic arms formed by bending downward and extending from the left side and the right side of the main body portion;

two lower abutting portions, wherein each of the lower abutting portions is formed by extending backward from one of the lower elastic arms to downward abut the circuit board;

a connecting portion connecting the two lower elastic arms and having two ends corresponding to the two lower elastic arms and the two lower abutting portions, wherein each of the two ends of the connecting portion is located between a bending location of a corresponding one of the two lower elastic arms connected to the main body portion and a corresponding one of the two lower abutting portions, and the through slot extends to the connecting portion; and two position limiting portions provided by protruding outward from the left side and the right side of the main body portion, wherein the position limiting portions are located below the protruding portions to limit each of the terminals from moving upward, a height of each of the position limiting portions is between an upper end and a lower end of the through slot, and each of the position limiting portions and a corresponding one of the upper elastic arms overlap along a vertical direction.

2. The electrical connector according to claim 1, wherein two stopping blocks protrude toward each other from a left side and a right side of each of the accommodating holes, the two stopping block are located behind the main body portion to limit the main body portion from moving backward, and the two stopping block are located at a left side and a right side of the through slot and right below the upper elastic arms.

3. The electrical connector according to claim 2, wherein each of the stopping blocks has a guide surface formed backward and upward obliquely from a front side thereof, a lowest point of the guide surface is lower than a bending location of each of the upper elastic arms connected to the main body portion, and a highest point of the guide surface is higher than the bending location of each of the upper elastic arms connected to the main body portion.

4. The electrical connector according to claim 2, wherein each of the lower elastic arms comprises a first section bending backward from the main body portion and extending downward, and a second section extending backward and downward from the first section, a distance between the two second sections of the two lower elastic arms is greater than a distance between the two first sections of the two lower elastic arms of each of the terminals, the connecting portion connects the two first sections of the two lower elastic arms, and in a projection along the vertical direction, the two first sections of the two lower elastic arms of each of the terminals are located between the two stopping blocks of a corresponding one of the accommodating holes.

5. The electrical connector according to claim 4, wherein each of the lower abutting portions is formed by extending backward and downward from the second section of the one of the lower elastic arms, and the distance between the two second sections of the two lower elastic arms is greater than a distance between the two lower abutting portions of each of the terminals.

6. The electrical connector according to claim 1, wherein gaps exist between the position limiting portions and the protruding portions, such that each of the terminals is vertically movably positioned in a corresponding one of the accommodating holes, and the upper elastic arms, the upper abutting portions, the lower elastic arms and the lower abutting portions are all located at a rear side of the main body portion.

7. The electrical connector according to claim 1, wherein the terminals comprise a signal terminal and a ground terminal provided side-by-side symmetrically adjacent to each other in a left-right direction, and a distance between two adjacent upper elastic arms of the signal terminal and the ground terminal is less than a width of the strip connecting portion of the signal terminal or the ground terminal.

8. The electrical connector according to claim 1, wherein the terminals comprise a signal terminal and a ground terminal provided side-by-side adjacent to each other in a left-right direction, and two outer sides of the two upper elastic arms pass outward beyond two outer sides of the two position limiting portions of each of the terminals.

9. The electrical connector according to claim 1, wherein each of a left side and a right side of the strip connecting section has a tearing edge formed by tearing from a corresponding one of the upper elastic arms, the tearing edge at the left side of the strip connecting section passes leftward beyond a left side of the through slot, and the tearing edge at the right side of the strip connecting section passes rightward beyond a right side of the through slot.

10. An electrical connector, configured to be electrically connected to a mating component, the electrical connector comprising:

an insulating body, provided with a plurality of accommodating holes running through the insulating body vertically, wherein each of the accommodating holes is provided with two protruding portions; and a signal terminal and a ground terminal provided side-by-side adjacent to each other in a left-right direction, correspondingly accommodated in the accommodating holes, wherein the ground terminal is provided with:

a main body portion, having a through slot running through the main body portion along a front-rear direction;

two upper elastic arms formed by bending upward and extending from a left side and a right side of the main body portion;

at least one upper abutting portion located behind the main body portion, configured to upward abut the mating component;

two lower elastic arms formed by bending downward and extending from the left side and the right side of the main body portion;

a connecting portion connecting the two lower elastic arms and having two ends corresponding to the two lower elastic arms, wherein each of the two ends of the connecting portion is located below a bending location of a corresponding one of the two lower elastic arms connected to the main body portion, and the through slot extends to the connecting portion; and two position limiting portions provided by protruding from the left side and the right side of the main body portion, wherein the position limiting portions are located below the protruding portions to limit the ground terminal from moving upward, a height of each of the position limiting portions is between an upper end and a lower end of the through slot, and along a vertical direction, each of the position limiting portions and a corresponding one of the upper elastic arms overlap, and the through slot and a gap between the two upper elastic arms overlap.

11. The electrical connector according to claim 10, wherein a strip connecting portion is formed by extending upward from the main body portion to be connected to a strip, the strip connecting portion is located between the two upper elastic arms, two upper abutting portions and two lower abutting portions are provided, each of the upper abutting portions is formed by extending backward from one of the upper elastic arms, each of the lower abutting portions is formed by extending backward from one of the lower elastic arms to downward abut a circuit board, two stopping blocks protrude toward each other from a left side and a right side of each of the accommodating holes, the two stopping block are located behind the main body portion to limit the main body portion from moving backward, and the two stopping block are located at a left side and a right side of the through slot and right below the upper elastic arms.

12. The electrical connector according to claim 11, wherein each of the lower elastic arms comprises a first section bending backward and downward from the main body portion and extending downward, and a second section extending backward and downward from the first section, a distance between the two second sections of the two lower elastic arms is greater than a distance between the two first sections of the two lower elastic arms, the connecting portion connects the two first sections of the two lower elastic arms, and in a projection along the vertical direction, the two first sections of the two lower elastic arms are located between the two stopping blocks of a corresponding one of the accommodating holes.

13. The electrical connector according to claim 11, wherein a distance between two adjacent upper elastic arms of the signal terminal and the ground terminal provided side-by-side symmetrically adjacent to each other in the left-right direction is less than a width of the strip connecting portion of the signal terminal or the ground terminal.

14. The electrical connector according to claim 11, wherein each of a left side and a right side of the strip connecting section has a tearing edge formed by tearing from a corresponding one of the upper elastic arms, the tearing edge at the left side of the strip connecting section passes leftward beyond a left side of the through slot, and the tearing edge at the right side of the strip connecting section passes rightward beyond a right side of the through slot.

15. The electrical connector according to claim 10, wherein each of the left side and the right side of the main body portion is provided with one of the position limiting portions, and two outer sides of the two upper elastic arms pass outward beyond two outer sides of the two position limiting portions of each of the terminals.

* * * * *